US005757395A

United States Patent [19]

Chew et al.

[11] Patent Number: 5,757,395

[45] Date of Patent: May 26, 1998

[54] COLOR CAPABLE SINGLE-CARTRIDGE INKJET SERVICE STATION

[75] Inventors: Chee Chuan Chew; Ng Keng Leong, both of Singapore, Singapore

[73] Assignee: Hewlett-Packard Company, Palo Alto, Calif.

[21] Appl. No.: 533,136

[22] Filed: Sep. 25, 1995

[51] Int. Cl.[6] ..... B41J 2/165

[52] U.S. Cl. ..... 347/24; 347/29; 347/32

[58] Field of Search ..... 347/29, 30, 22, 347/33, 24

[56] References Cited

U.S. PATENT DOCUMENTS

| | | | |
|---|---|---|---|
| 4,853,717 | 8/1989 | Harmon et al. | 346/140 R |
| 4,935,753 | 6/1990 | Lehmann et al. | 346/140 R |
| 5,081,472 | 1/1992 | Fisher | 346/140 R |
| 5,103,244 | 4/1992 | Gast et al. | 346/1.1 |
| 5,115,250 | 5/1992 | Harmon et al. | 346/1.1 |
| 5,138,343 | 8/1992 | Aichi et al. | 346/140 R |
| 5,146,243 | 9/1992 | English et al. | 346/140 R |
| 5,151,715 | 9/1992 | Ward et al. | 346/140 R |
| 5,155,497 | 10/1992 | Martin et al. | 347/33 |
| 5,252,993 | 10/1993 | Tomii et al. | 346/140 R |
| 5,300,958 | 4/1994 | Burke et al. | 346/140 R |
| 5,455,608 | 10/1995 | Stewart et al. | 347/19 |
| 5,563,637 | 10/1996 | Francis et al. | 347/33 |
| 5,587,729 | 12/1996 | Lee et al. | 347/33 |

FOREIGN PATENT DOCUMENTS

| | | | |
|---|---|---|---|
| 0526014 | 2/1993 | European Pat. Off. | B41J 2/165 |
| 59-209876 | 11/1984 | Japan | B41J 3/04 |
| A2231143 | 9/1990 | Japan | B41J 2/165 |
| A2235761 | 9/1990 | Japan | B41J 2/165 |
| A4110156 | 4/1992 | Japan | B41J 2/165 |
| A4141440 | 5/1992 | Japan | B41J 2/165 |
| A5116331 | 5/1993 | Japan | B41J 2/165 |

OTHER PUBLICATIONS

Hewlett-Packard Patent application Ser. No. 08/059402 filed on May 11, 1993.

Hewlett-Packard Company, the present assignee of Ser. No. 08/348,624, filed on Dec. 3, 1994, first offered for sale to OEM manufacturers as a facsimile inkjet mechanism, known as the GPM-3 engine, in Jul. 1993. Two sketches showing the service station assembly for the GPM-3 engine.

Hewlett-Packard Patent application Ser. No. 08/289876 filed Aug. 12, 1994.

Hewlett-Packard Patent application Ser. No. 08/218391 filed Mar. 25, 1994.

GPM3 Service Station Design first sold by Hewlett-Packard Company on Jul. 1, 1993.

*Primary Examiner*—Benjamin R. Fuller
*Assistant Examiner*—Thien Tran
*Attorney, Agent, or Firm*—Flory L. Martin

[57] ABSTRACT

A service station for a single-cartridge inkjet printing mechanism interchangeably receives different types of inkjet cartridges, with each type of cartridge having different servicing needs. To hermetically seal each cartridge printhead during periods of inactivity, two caps are gimbal-mounted at opposing ends of a retaining sleeve. The caps are spring-biased away from one another by a single spring, which may be compressed during printhead capping to accommodate for variations in printhead height between different cartridges. Gimbal mounting the caps allows each cap to compensate for any tilting of the printhead face when the cartridge is installed, which insures an adequate seal. The sleeve is rotated to bring the proper cap into alignment with the installed printhead. The service station also has two wipers, a spittoon, and a carriage locking mechanism. A method is also provided of servicing different types of cartridges in a single-cartridge inkjet printing mechanism.

19 Claims, 7 Drawing Sheets

FIG. 8
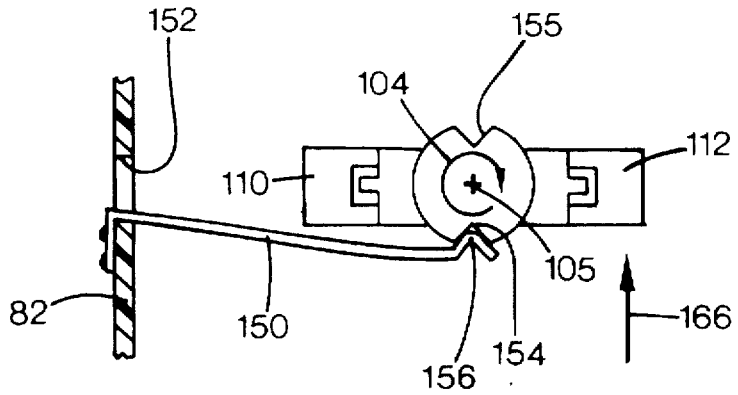
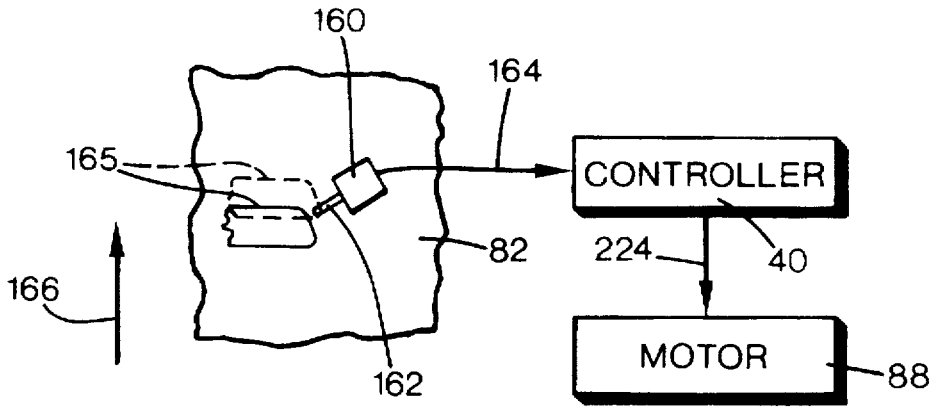
FIG. 9

FIG. 10
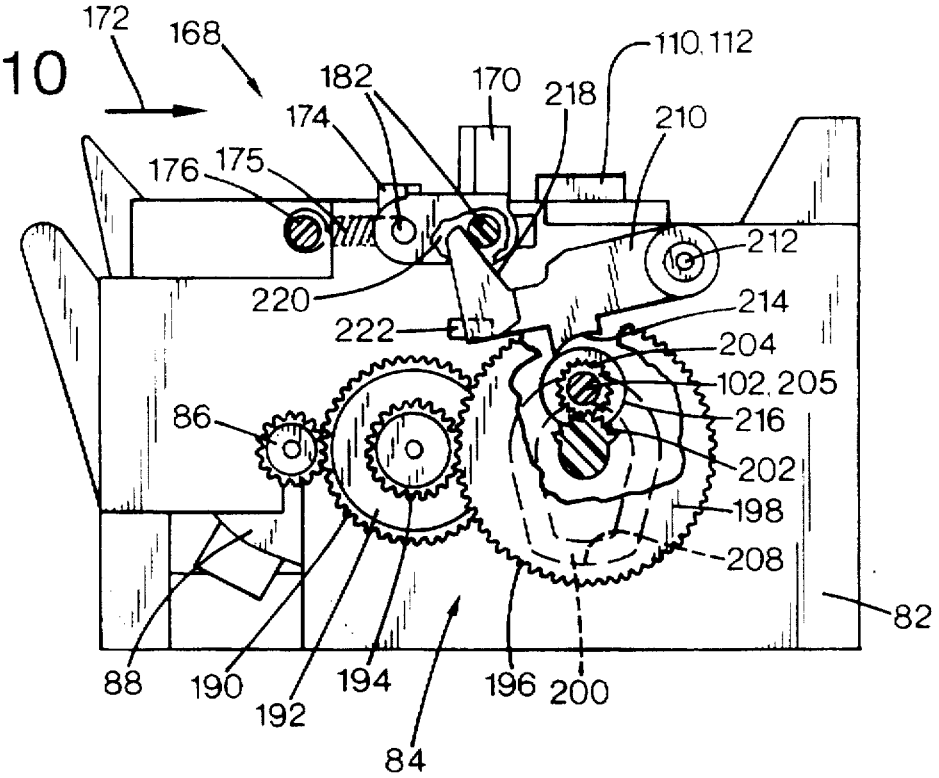
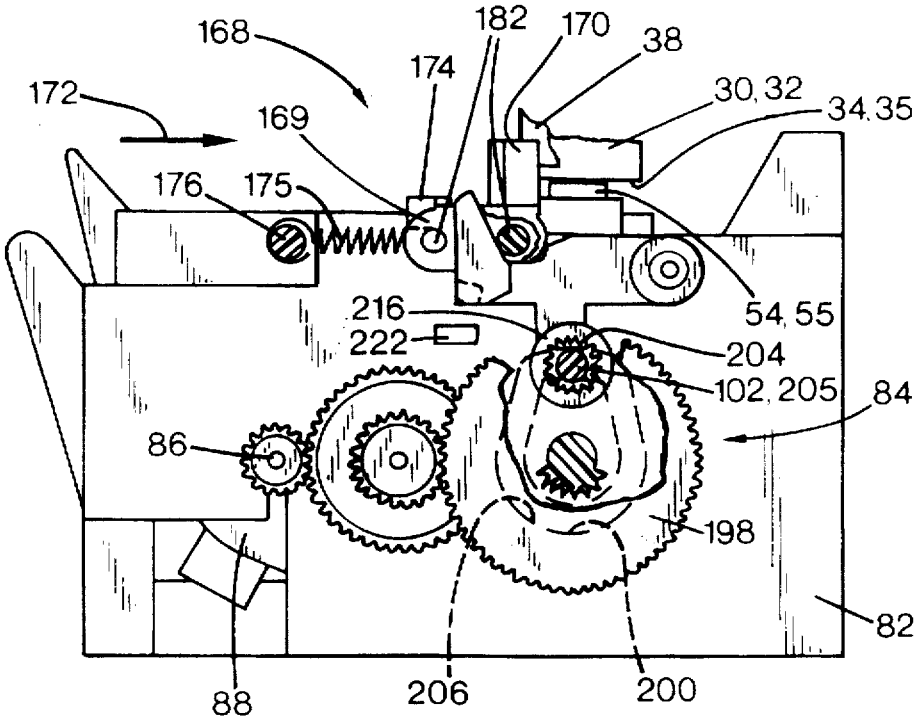
FIG. 11

COLOR CAPABLE SINGLE-CARTRIDGE INKJET SERVICE STATION

FIELD OF THE INVENTION

The present invention relates generally to inkjet printing mechanisms, and more particularly to a service station for a single-cartridge inkjet printing mechanism that interchangeably receives one of at least two different types of inkjet cartridges, with each type of cartridge having different servicing needs.

BACKGROUND OF THE INVENTION

Inkjet printing mechanisms use cartridges or "pens" which shoot drops of liquid colorant, referred to generally herein as "ink," onto a page. Each pen has a printhead formed with very small nozzles or slits through which the ink drops are fired. To print an image, the printhead moves back and forth across the page shooting ink drops as it moves. To clean and protect the printhead, typically a "service station" mechanism is mounted within the printer chassis. For storage, or during non-printing periods, service stations usually include a capping system which seals the printhead nozzles from contaminants and drying. Some caps are also designed to facilitate priming, such as by being connected to a pumping unit that draws a vacuum on the printhead.

During operation, clogs in the printhead are periodically cleared by firing a number of drops of ink through each of the nozzles in a process known as "spitting." Typically, the waste ink is collected in a stationary reservoir portion of the service station, which is often referred to as a "spittoon." After spitting, uncapping, or occasionally during printing, most service stations have an elastomeric wiper that wipes the printhead surface to remove ink residue, as well as any paper dust or other debris that has collected on the printhead.

Some customers prefer to have a single-cartridge printing mechanism capable of receiving different types of cartridges, such as interchangeable monochrome and multicolor inkjet cartridges. The monochrome cartridge typically carries a black ink for printing text, and the multicolor cartridge typically carries the colors of cyan, magenta and yellow for printing graphics, pictures, charts, etc. The multicolor cartridge prints a "composite" or "process " black by applying droplets of each color (cyan, magenta and yellow) to a single location on the page, as opposed to a "true black" printed with ink ejected from a black ink cartridge. While the flexibility of such an interchangeable single-cartridge printer is quite desirable for some consumers, unfortunately, the servicing needs of the monochrome and multicolor pens are often different, requiring a service mechanism that readily adapts to either type of pen.

For example, the pens may use different types of inks which are incompatible, such as a pigment based ink for the black pen, and dye based inks for the multicolor pen. Other ink formulations are designed so the black and color inks are mutually precipitating to prevent bleeding at black/color borders by promoting faster drying on the page. If such mutually precipitating formulations were used a single-cartridge printer, contamination of one printhead with residue left on the servicing elements from the other printhead could induce nozzle clogging. There may also be other reasons to isolate the servicing components for each type of pen from contamination by ink residue from the other pen, for instance, to prevent muddying of the color inks with black ink residue.

In many cartridge designs, the placement and number of nozzles on the monochrome and multicolor printheads varies. For instance, the color nozzles typically occupy a larger area of the printhead face than the black nozzles, so the physical size requirements for the black and color servicing elements are different. Thus, for a variety of reasons separate sets of servicing elements are required for each type of cartridge installed in the printing mechanism.

In an interchangeable single-cartridge printing mechanism, as well as other printing mechanisms, it is desirable for the service station to readily accommodate printheads having slight variations in vertical alignment, often referred to as "pen-to-media" or "pen-to-paper" spacing. In the past, these variations in vertical height were accommodated by compressing the elastomeric material of the pen caps and flexing the elastomeric material of the pen wipers. Unfortunately, after periods of long storage with the caps under extreme compression, such as due to a closer than normal pen-to-media spacing, the elastomeric material of the caps may take a permanent set. With the caps failing to return to the original height, if the next pen installed has a greater than normal pen-to-media spacing, then it may not be adequately sealed. This situation may lead to premature drying of the ink inside the pen, which may be both costly and inconvenient for an operator.

Thus, in a single-cartridge inkjet printer capable of interchangeably receiving different types of pens, the service station must accommodate the servicing needs of each type of pen without contaminating one pen with residue from the other pen.

SUMMARY OF THE INVENTION

According to one aspect of the present invention, a service station is provided for servicing the printheads of interchangeable first and second inkjet cartridges installed in a single-cartridge inkjet printing mechanism. The service station has a frame and a restraining sleeve pivotally and translationally coupled to the frame. The sleeve defines a hollow interior that terminates in opposing first and second ends. The service station has a first cap restrained within the hollow interior of the sleeve and sized to seal the first cartridge, and a second cap restrained within the hollow interior of the sleeve and sized to seal the second cartridge. A biasing member is received within the hollow interior of the sleeve to bias the first and second caps toward the respective first and second ends of the sleeve.

According to another aspect of the present invention, a method is provided of servicing the printheads of first and second inkjet cartridges interchangeably installed in a single-cartridge inkjet printing mechanism. The method includes the step of identifying which of the first and second inkjet cartridges is installed in the printing mechanism. In a rotating step, a cap retaining sleeve holding first and second printhead caps is rotated to place the first cap in a printhead sealing position when the first inkjet cartridge is identified, and to place the second cap in the printhead sealing position when the second inkjet cartridge is identified. In a biasing step, the first and second caps are biased toward opposite ends of the retaining sleeve using a single biasing member.

According to a further aspect of the present invention, a single-cartridge inkjet printing mechanism is provided for receiving either a first inkjet cartridge or a second inkjet cartridge, with the first and second inkjet cartridges each having a printhead with mutually different servicing requirements. The printing mechanism has a chassis and a reciprocating carriage that interchangeably receives either the first inkjet cartridge or the second inkjet cartridge. A controller is coupled to the carriage to determine whether the first inkjet cartridge or the second inkjet cartridge is installed in the carriage. The printing mechanism also has a service station, which may be as described above.

In an illustrated embodiment, the service station has a drive mechanism coupled to the sleeve to rotate and translate the sleeve to selectively position either the first or the second cap into a printhead sealing position. A microswitch feedback device communicates to an initial sleeve position to the controller, and the drive mechanism rotates and translates the sleeve in response to the controller. A locking mechanism coupled to the drive mechanism to selectively secures the installed cartridge in a printhead sealing position. The service station also has a tumbler assembly that pivotally and translationally couples the sleeve to the chassis. A first wiper is supported by the tumbler assembly to be rotated into a printhead wiping position to wipe the printhead of the first cartridge when installed, and a second wiper supported by the tumbler assembly to be rotated into a printhead wiping position to wipe the printhead of the second cartridge when installed.

An overall goal of the present invention is to maintain cartridge health and provide a single-cartridge inkjet printing mechanism which prints sharp vivid images when using either a monochrome inkjet cartridge or a multicolor inkjet cartridge.

A further goal of the present invention is to provide a method of servicing different types of inkjet cartridges which may be interchangeably installed in a single-cartridge inkjet printing mechanism.

BRIEF DESCRIPTION OF THE DRAWINGS

FIG. 8 is a side elevational view of a portion of the service station, taken along lines 8—8 of FIG. 4.

FIG. 9 is a partially schematic view of a portion of the service station of FIG. 1, showing interaction of the service station and the printer controller.

FIG. 10 is a side elevational view taken along lines 10—10 of FIG. 4 showing an uncapped position of the drive mechanism of the service station of FIG. 1.

FIG. 11 is a side elevational view taken along lines 10—10 of FIG. 4, but here, showing an alternate capped position of the service station of FIG. 1.

DETAILED DESCRIPTION OF A PREFERRED EMBODIMENT

Figure 1:
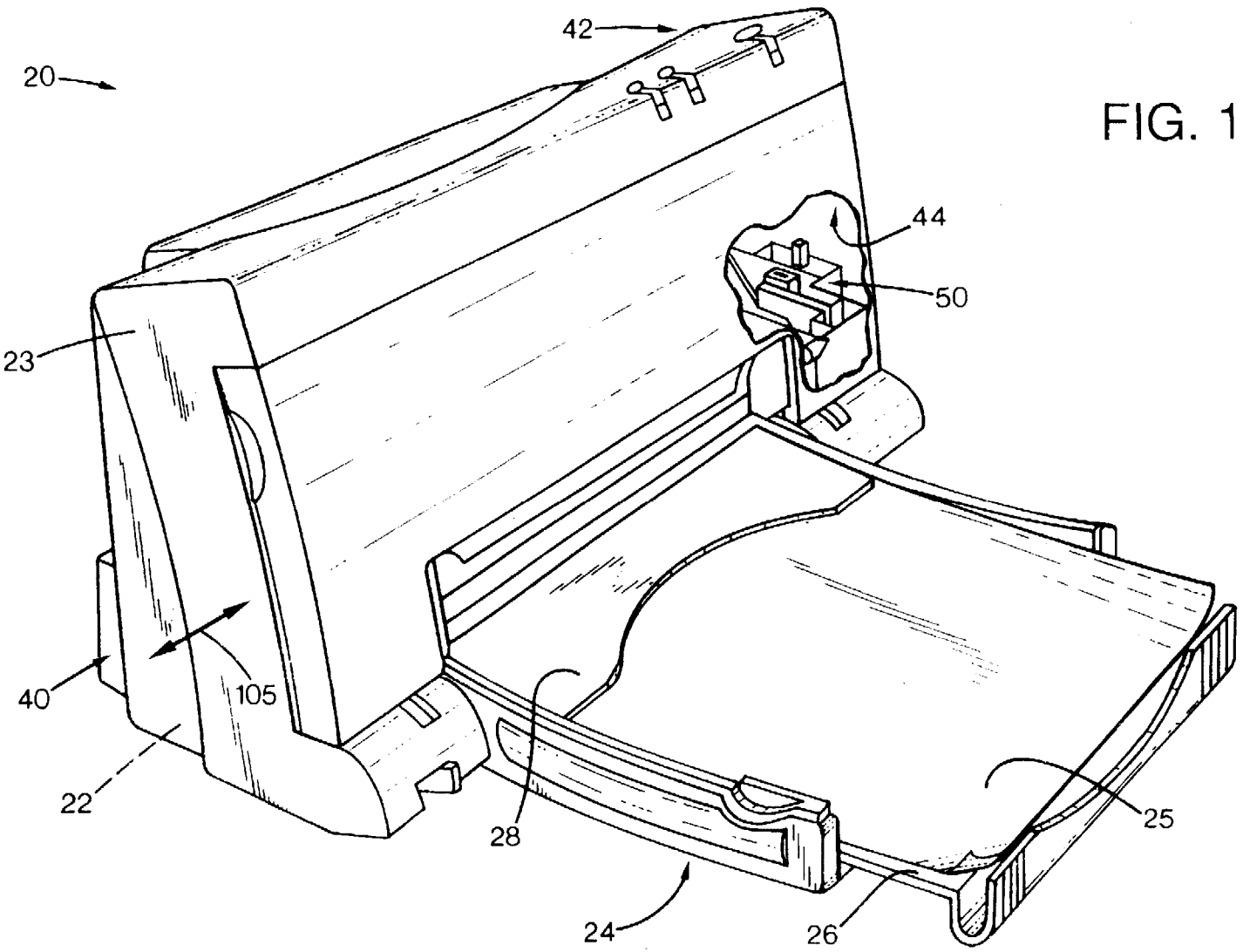
FIG. 1 is a partially cut away perspective view of one form of an inkjet printing mechanism, here an inkjet printer, incorporating one form of the service station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 which may be surrounded by a casing, housing or enclosure 23, preferably of a plastic material. The printer 20 also includes a print medium handling system 24 for supplying sheets of print media to the printer 20. Using a series of conventional motor-driven rollers (not shown), the media handling system 24 moves a sheet or page of print media 25 from an input feed tray 26, through a print zone inside the housing 23 for printing, then to an output tray 28. The print media 25 may be any type of suitable sheet material, such as paper, card-stock, transparencies, mylar, foils, and the like, but for convenience, the illustrated embodiment is described using paper as the print medium.

In the print zone, the paper 25 receives ink from a single inkjet cartridge, which may be selected from several different types of inkjet cartridges. In the illustrated embodiment, the cartridge in use is selected from either a black ink cartridge 30 or a color ink cartridge 32, which are illustrated schematically in FIGS. 2 and 3 in positions for servicing. The inkjet cartridges 30, 32 are commonly referred to as "pens" by those in the art. The illustrated color pen 32 is a tri-color pen, which for the purposes of illustration, is described as containing three dye based ink colors, such as cyan, yellow and magenta. In some embodiments, a monochrome color pen may be used, rather than the black pen 30. The black ink pen 30 is illustrated herein as also containing a dye based ink. It is apparent that other types of inks may also be used in pens 30, 32, such as pigment-based inks, paraffin based inks, as well as hybrid or composite inks having both dye and pigment characteristics.

The illustrated cartridges or pens 30, 32 each include reservoirs for storing a supply of ink therein, although other ink supply storage arrangements may also be used, such as those having reservoirs (not shown) mounted along the chassis 22. The cartridges 30, 32 have printheads 34, 35 respectively. Each printhead 34, 35 has a bottom surface comprising an orifice plate with a plurality of nozzles formed therethrough in a manner well known to those skilled in the art. The illustrated printheads 34, 35 are thermal inkjet printheads, although other types of printheads may be used, such as piezoelectric printheads. The printheads 34, 35 typically include a plurality of resistors which are associated with the nozzles. Upon energizing a selected resistor, a bubble of gas is formed ejecting a droplet of ink from the nozzle and onto a sheet of paper 25 under the nozzle.

Figure 3:
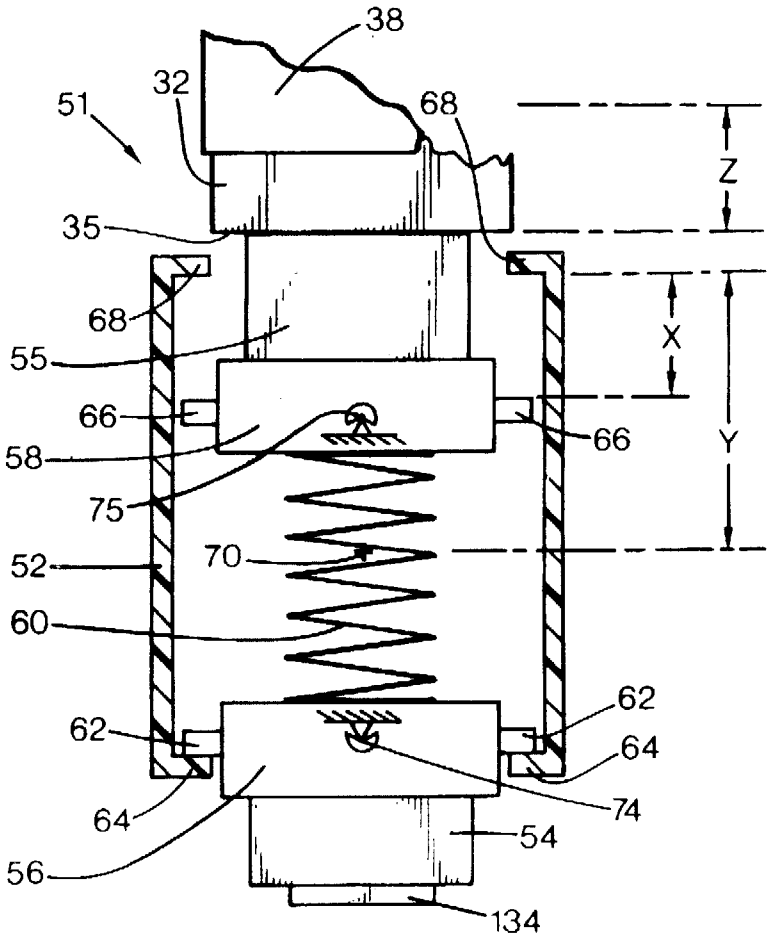
FIG. 3 is a schematic view of one form a capping device of the service station of FIG. 1, shown in a capped position.

The selected pen 30 or 32 may be transported reciprocally from side to side over the paper 25 by a conventional motor-driven carriage arrangement 38, shown schematically in FIG. 3. The pens 30, 32 selectively deposit one or more ink droplets on the page 25 in accordance with instructions received from a printer controller, such as a microprocessor which may be mounted to the chassis 22 at the area indicated generally by arrow 40. A host device, which is typically a computer, such as a personal computer, generates instruction signals which may be communicated to the controller 40 in a conventional manner. The printhead carriage motor and the paper handling system drive motor operate in response to the printer controller 40, which operates in a manner well known to those skilled in the art. The printer controller may also operate in response to user inputs provided through a keypad, which may be located on the exterior of the casing 23 in the region generally indicated by arrow 42. A monitor may be coupled to the host computer to display visual information to an operator, such as the printer status or a particular program being run on the computer. Personal computers, their input devices, such as a keyboard and/or a mouse device, and monitors are all well known to those skilled in the art.

A cartridge servicing chamber 44 is defined by the printer chassis 22 and the casing 23 at one end of the travel path of the printhead carriage 38, to the right side in FIG. 1. A printhead service station 50 is mounted to the chassis within the servicing chamber 44 to service whichever of the two pens 30, 32 is mounted in the printer 20. Before discussing the illustrated embodiment of the service station 50 in detail, the general concepts of the capping scheme of this service station will be described with respect to FIGS. 2 and 3. As mentioned in the background section above, earlier printers accommodated for variations in the pen-to-paper spacing (the vertical height of the printhead) for different pens by relying on different degrees of compression of the elastomeric material of the printhead cap. Unfortunately, the elastomeric cap material was often susceptible to taking a permanent set if over-compressed, which may leave a shorter pen installed later inadequately sealed.

Figure 2:
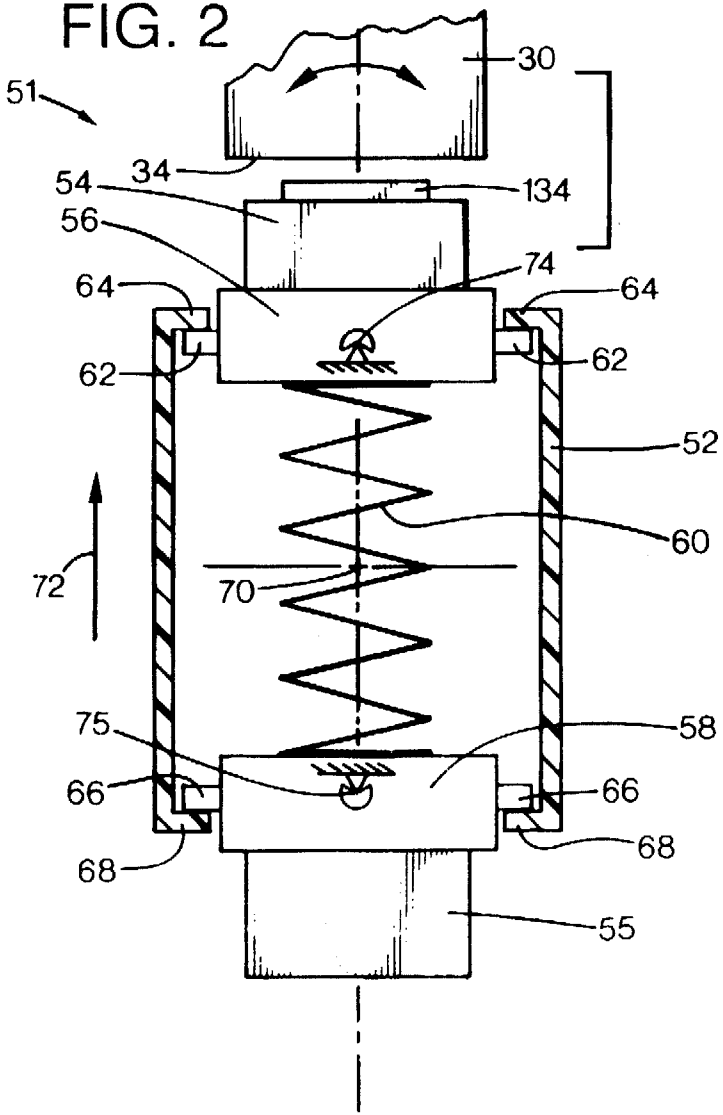
FIGS. 2 is a schematic view of one form a capping device of the service station of FIG. 1, shown in an uncapped position.

FIGS. 2 and 3 illustrate the general concepts of a rotary mono-cartridge or single-cartridge capping assembly 51 which includes a capturing member, such as a rotary retaining sleeve member 52, and a black cap 54 and a color cap 55. The black and color caps 54, 55 are mounted to respective base units 56, 58, which are slidably received within the interior of sleeve 52. A biasing member, such as spring 60, forces the bases 56, 58 away from each other, and toward opposite ends of sleeve 52. Other mechanisms for resiliently biasing the caps 54, 55 away from one another within a capturing member, other than the illustrated spring 60 and sleeve 52, may also be used, although use of a single biasing member advantageously simplifies the design for cost considerations and ease of assembly.

To retain the bases 56, 58 within the sleeve member, the black base 56 includes a pair of runner members 62, which stop against a pair of restraining members 64 located at one end of the sleeve 52. Similarly, the color base unit 58 has a pair of runner members 66, which slide within the interior of sleeve 52, until encountering a second pair of sleeve restraining members 68. In the illustrated cross sectional view, the restraining members 64, 68 and the runner members 62, 66 appear as discrete fingers, although other shapes, for example, an annular shape or segmented shapes, may also be implemented.

Comparing FIGS. 2 and 3, one can see that the sleeve 52 has been rotated 180° around a tumbler axis 70, using a mechanism described further below with reference to FIGS. 10 and 11. In FIG. 2, the black cap 54 is in an upright position, ready to be moved upwardly as indicated by arrow 72 to seal the black printhead 34. After pivoting the sleeve 52 around the tumbler axis 70, FIG. 3 shows the sleeve 52 has been moved upwardly so color cap 55 can seal the color printhead 35. To provide a positive seal, the spring 60 has been compressed so the base unit 58 has been forced deeper into the interior of the sleeve 52.

To accommodate for any misalignment of the printheads 34, 35 with respect to a reference plane, here a horizontal plane, preferably both of the base units 56, 58 are gimbal-mounted to spring 60, as indicated schematically by pivot points 74, 75, respectively FIGS. 2 and 3). This gimbal mounting of the bases 56, 55 allows them to tilt with respect to the sleeve 52. This tilting action promotes a good seal by accommodating any lack of parallelism between the printhead faces 34, 35 and the sealing lips of caps 54, 55.

To accommodate for variations in the printhead vertical height (the pen-to-paper spacing), indicated as distance Z in FIG. 3, the cap in use, 54 or 55, may move downwardly within the sleeve 52, by compressing spring 60 as shown for cap 55 in FIG. 3. Preferably, the spring 60 is selected so that the maximum required travel of the bases 56, 58 and the respective caps 54, 55, as indicated by distance Y in FIG. 3, accommodates the vertical variations of the printhead face Z. Preferably, spring 60 is also selected to facilitate a required compression factor for the elastomeric caps 54, 55 so the caps are adequately compressed to provide an adequate seal around the nozzles of printheads 34, 35. For example, it is believed that a suitable spring force operating range for spring 60 is 140–160 grams of force, particularly for elastomeric caps 54, 55 which have a Shore A durometer selected within the range of 25–50, with a nominal value of 35 plus or minus a standard tolerance value of 5, for instance. Moreover, it is particularly advantageous to select a spring which has a gradual spring rate, that is a very gradual change in the amount of spring force applied for different spring deflections to accommodate the varying values of X shown in FIG. 3.

FIGS. 4–7 illustrate a preferred embodiment of the capping assembly 51 as incorporated into the service station 50. Here, the service station 50 includes a rotary tumbler assembly 80 (FIGS. 5–7) which is cam-mounted within a service station frame 82 (FIG. 4) for pivotal (rotary) motion and for translational motion. The service station 50 includes a drive mechanism, such as a drive gear and cam assembly 84, which may be secured to an outer wall of the service station frame 82. The drive mechanism 84 is driven by a pinion gear 86, which serves as an output for a motor 88, such as a conventional stepper motor. The stepper motor 88 rotates in response to control signals received from the printer controller 40. The operation of the illustrated drive mechanism 84 is shown in FIGS. 10 and 11, described further below.

Figure 4:
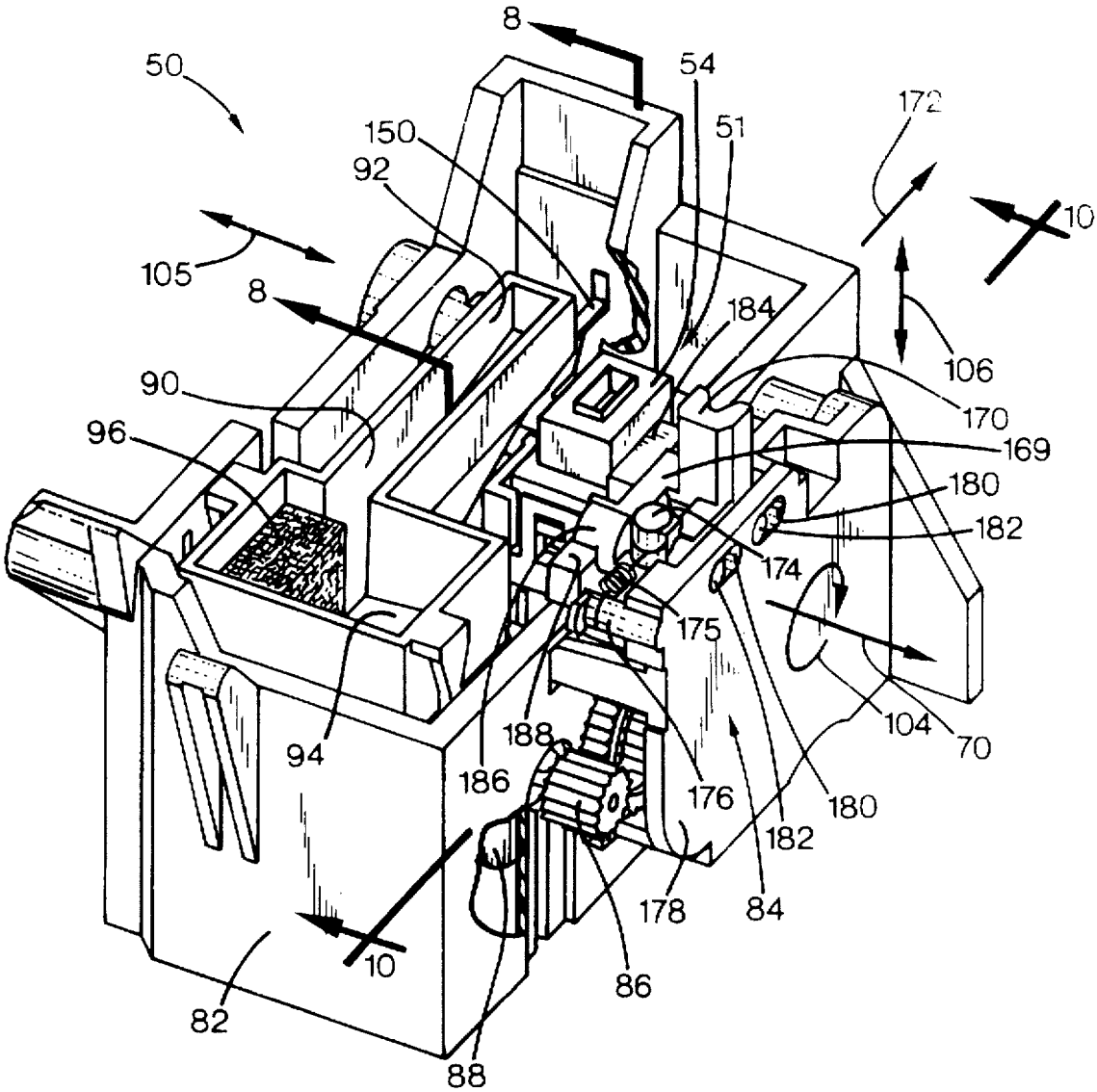
FIG. 4 is a perspective view of the service station of FIG. 1.

As best shown in FIG. 4, the service station 50 also has an ink collection reservoir or "spittoon" portion 90, which may comprise one or more spittoon chambers. The illustrated spittoon 90 has a single chamber including an input trough or catch basin 92 and a main reservoir portion 94. The catch basin 92 receives ink that is selectively ejected or "spit" from pens 30, 32 when they are positioned above the trough. The basin 92 slopes downwardly toward the main reservoir 94, so the ink liquid components may flow from the basin 92 to the reservoir 94 under the force of gravity. A recessed deeper portion of the main reservoir 94 may be filled with an absorbent liner or pad 96 to absorb the liquid components of purged inks, such as solvents and carriers, which eventually evaporate from the liner 96. Typical liquid absorbent materials for liner 96 include felt, pressboard, sponge, foam, or other comparable materials known to those skilled in the art.

Figure 5:
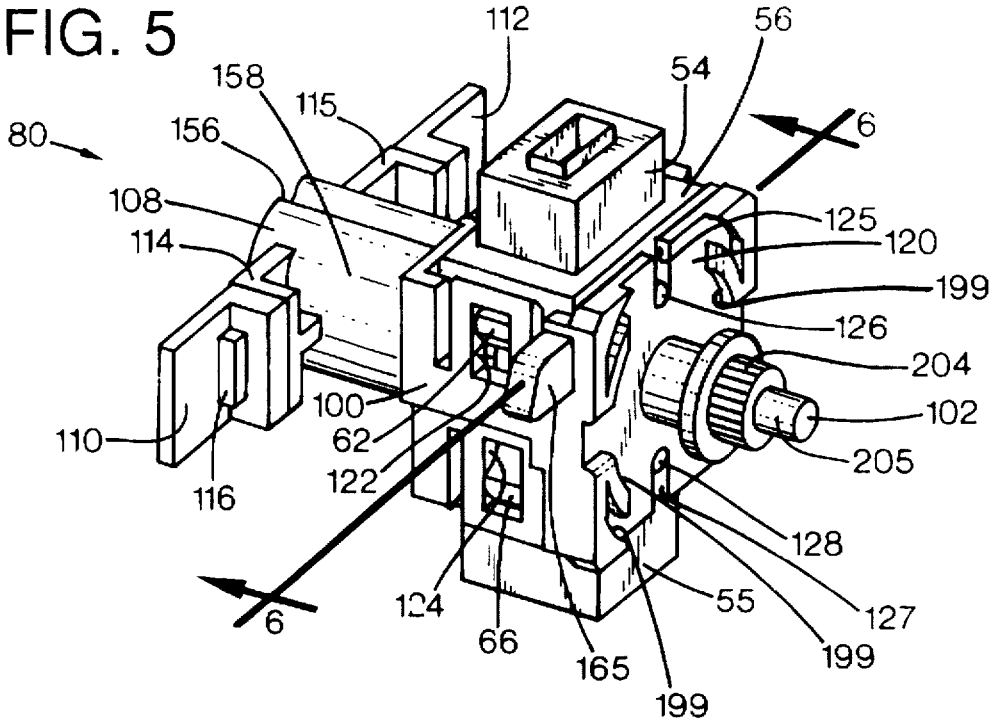
FIG. 5 is a perspective view of the rotary portion of the service station of FIG. 1.
Figure 6:
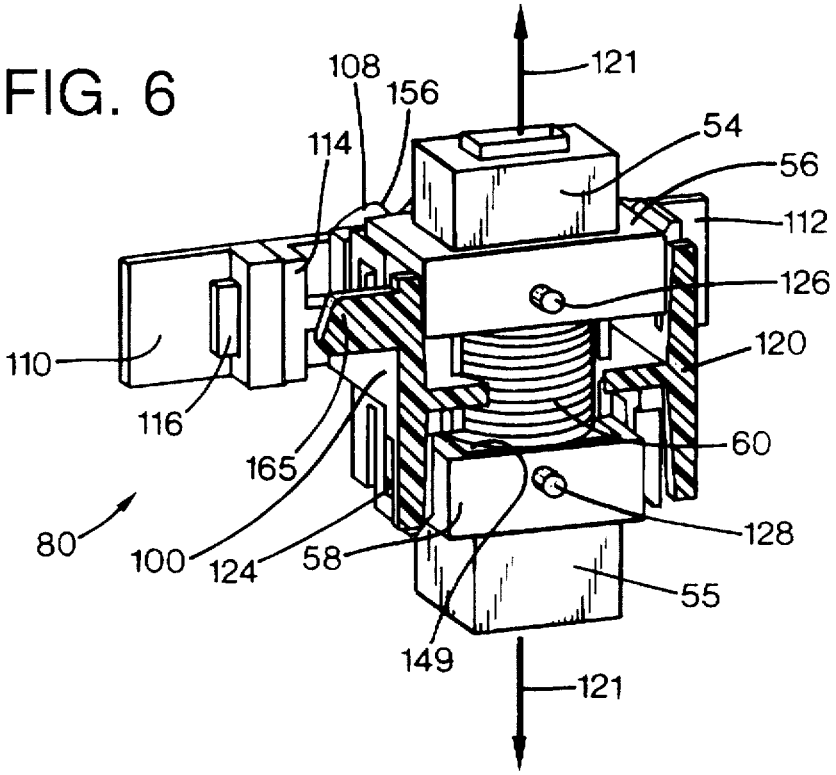
FIG. 6 is a sectional perspective view taken along lines 6—6 of FIG. 5.
Figure 7:
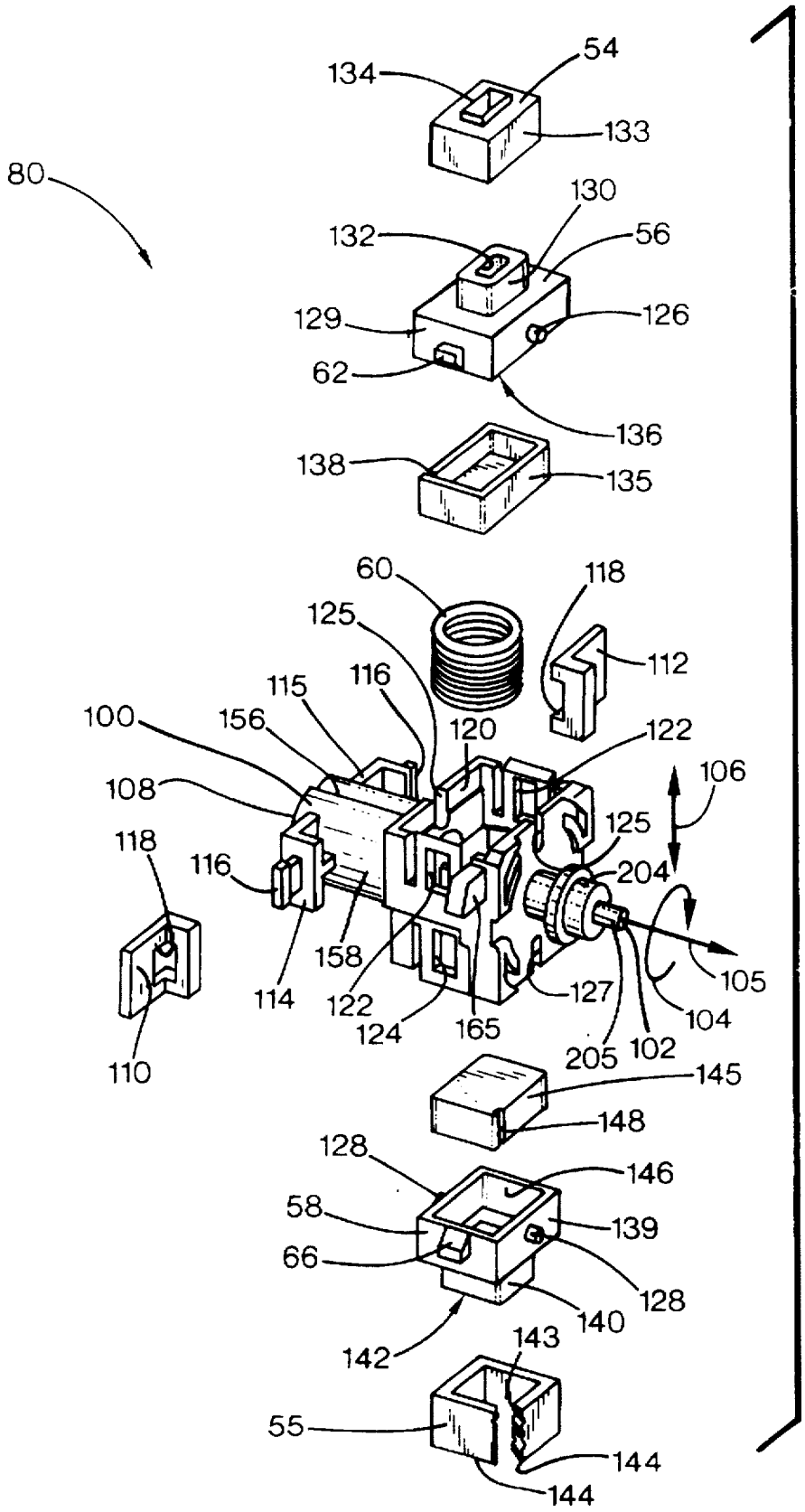
FIG. 7 is a partially fragmentary, exploded perspective view of the rotary portion of the service station shown in FIG. 5.

FIGS. 5–7 show the rotary tumbler assembly 80 has a tumbler body 100, which terminates at one end in a drive shaft 102. The shaft 102 is engaged and driven by the drive mechanism 84 for rotation, as indicated by the curved arrow 104 around the tumbler axis 70 in FIG. 4. This tumbler axis 70 is preferably substantially parallel to a printhead scanning axis 105, along which the carriage 38 carries pens 30, 32 across the print zone and over the service station 50. The drive mechanism 84 also raises and lowers the tumbler body 100, as indicated by the double headed arrow 106, to cap and uncap the printheads 34, 35, which is described below with respect to FIGS. 10 and 11.

Opposite the drive end shaft 102, the tumbler body 100 has a floating end shaft 108. The floating shaft 108 supports a black printhead wiper 110, and a color printhead wiper 112. The wipers 110, 112 may be of an elastomeric material, for instance a nitrile rubber, an ethylene polypropylene diene monomer (EPDM) elastomer, or other types of rubber-like materials known to those skilled in the art. The wiping action is achieved by moving the printheads 34, 35 along the scanning axis 105 across the wipers 110 and 112.

The floating shaft 108 supports a black wiper base 114 and a color wiper base 115, which are preferably molded as a single integral unit as shown in FIG. 7. Each of the wiper bases 114, 115 has an upwardly projecting T-shaped member 116 that is sized to fit through slots 118 defined by each of the black and color wipers 110 and 112 (FIG. 7). During assembly, the wipers 110, 112 may be stretched to expand the size of slot 118 to fit over the head portion of the T-shaped member 116, which then retains the wipers in place as slots 118 contract in size to snugly surround the stem portion of member 116.

The tumbler body 100 also supports a cap-retaining sleeve member 120 having a longitudinal axis 121 (FIG. 5). Preferably, the tumbler body 100 and the sleeve 120 are integrally formed as a single molded plastic unit. The sleeve 120 operates as described above for sleeve 52 in FIGS. 2 and 3. For the illustrated tumbler assembly 80, sleeve 120 includes a pair of opposing black guide channels 122 which serve as the restraining members 64 to secure the black base 56 within the hollow interior of sleeve 120. The black base 56 has two runner members 62, which are slidably received within the guide channels 122. Similarly, the sleeve 120 also has a pair of opposing color guide channels or slots 124, which function as the restraining members 68 of FIGS. 2 and 3, to slidably receive and restrain the runner members 66 of the color base 58.

The black and color caps 54, 55 are able to pivot slightly within sleeve 120 to adapt for any tilting or canting of the faces of printheads 34, 35. This pivoting action is provide by adding a pair of pivot supports to each of the cap bases 56, 58. As shown in FIGS. 5–7, the illustrated sleeve 120 defines a pair of opposing open-ended channels or slots 125, which slidably receive a pair of pivot posts located on opposing sides of the black cap base 56, such as pivot post 126. At the color end of the sleeve 120, the tumbler body 100 also defines a pair of opposing open-ended channels or slots, such as slot 127. The pair of slots 127 slidably receive a pair of pivot posts, such as pivot post 128, located on opposite sides of the color base 58. The slots 125, 127, posts 126, 128, channels 122, 124 and runners 62, 66, allow the sleeve 120 to support the cap bases 56, 58 so the caps 54, 55 can move translationally into the sleeve interior, while also pivoting or gimballing to tilt the cap sealing lips to seal an imperfectly seated or manufactured printhead face.

As best shown in FIG. 7, the caps 54, 55 and the cap bases 56, 58 are all generally tubular in nature, being open at each end and, here, each having a rectangular cross section. The black base 56 has a pedestal 129 and an upwardly extending neck 130, which defines a throat 132. The black cap 54 has a lower mounting portion or cuff 133 that surrounds the base neck 130. Projecting upwardly from the cuff 133, the black cap 54 has a sealing lip 134 sized to surround the nozzles of the black printhead 34. A black cap cover 135 is preferably received within an interior portion 136 of the base pedestal 129 to form a substantially hermetic sealing chamber around the nozzles of printhead 34 when capped. Preferably, the cover 135 is cup-shaped and of an elastomeric material, such as a Santoprene® or other ink-phyllic compound, which yields during capping and barometric changes to prevent depriming of the pen 30.

To further prevent depriming of the printhead 34 during the capping process, the black cover 135 and pedestal 129 cooperate to define a vent channel or passageway, here defined by a vertical groove 138 formed in cover 135, which allows air to leave the sealing chamber during the capping process. Thus, as the lip 134 engages the face of printhead 34, any pressure build up of air within the interior of the sealing chamber (defined by the printhead 34 when in contact with lips 134, interiors of the base 56 and cap cover 135), is vented to atmosphere through channel 138.

The color base 58 has a pedestal 139 and an upwardly extending neck 140, which defines a throat 142. The color cap 55 has a lower mounting portion or cuff 143 that surrounds the base neck 140. The cap 55 angles outwardly from the interior of cuff 143 to define a sealing lip 144, which is sized to surround the nozzles of the color printhead 35, as shown by the fragmented view of cap 55 in FIG. 7. A color cap cover 145 is preferably received within an interior portion 146 of the base pedestal 139 to form a substantially hermetic sealing chamber around the nozzles of the color printhead 35 when capped. Preferably, the cover 145 is cup-shaped and of an elastomeric material which yields during capping and barometric changes to prevent depriming of the pen 32.

The color cover 145 and pedestal 139 cooperate to define a vent channel or passageway, here defined by a vertical groove 148 formed in cover 145. This vent channel allows air to leave the sealing chamber during the capping process to prevent depriming of the printhead 35. Thus, as the lip 144 engages the face of printhead 35, any pressure build up of air within the interior of the sealing chamber (defined by the printhead 35 when in contact with lips 144, interiors of the base 58 and cap cover 145), is vented to atmosphere through channel 148.

The exterior exposed surfaces of the cap covers 135, 145 are advantageously recessed within the respective cap bases 56, 58 when seated therein to provide pockets within the interior regions 136, 146 of the bases. These pockets, such as pocket 149 defined by base 58 and cover 145 (FIG. 6), receive each end of spring 60. These recessed mounting pockets advantageously allow the bases 56, 58 and, thus, the caps 54, 55 to pivot and tilt with respect to the tumbler body 100, within the constraints defined by the clearances of channels 122, 124, 125 and 127.

Preferably, the guide slots 122, 124, the runners 62, 66, the channels 125, 127 and pivot posts 126, 128 are sized to allow the respective black and color caps 54, 56 to gimbal or rock on the ends of spring 60, to allow the caps 54, 55 to adapt for any variations in the parallelism of the printhead faces 34, 35, with respect to a designed reference plane, here, shown as a substantially horizontal plane. Thus, this gimbal mounting scheme provides for pivoting of the caps, as illustrated conceptually in FIGS. 2 and 3 by gimbal points 74 and 75. For example, if the face of printhead 34 tips down toward either the front or the back of printer 20, the runner members 62 slide to unequal heights within the guide channels 122. Similarly, if the printhead 34 tips toward either the left or right, the pivot posts 126 slide to unequal heights within channels 125.

As shown in FIG. 8, to bias the floating end 108 of the tumbler body 100 upwardly, particularly to assist in capping as well as wiping, the service station 50 includes a spring member, such as a leaf spring 150. The leaf spring 150 extends through a slot 152 defined by the service station frame 82. The floating shaft 108 defines two opposing notches 154, 155, with the leaf spring 150 being formed to define a knuckle 156 that fits within both notches 154 and 155. Preferably, the spring knuckle 156 rides around a mid-span portion 158 of shaft 108, located approximately under the spittoon catch basin 92. When the leaf spring knuckle 156 resides within notch 154, the black cap 54 is positioned for sealing printhead 34, whereas when knuckle 156 is within notch 155, the color cap 55 is positioned for sealing the color printhead 35.

Referring to FIG. 9, to provide positional feedback information to the printer controller 40, the service station 50 has a microswitch 160 which may be mounted to the service station frame 82. The microswitch 160 has a plunger 162, which when depressed issues a service station positional signal 164 to the printer controller 40. To activate the plunger 162, the tumbler body 100 has a trip finger 165, which protrudes outwardly from sleeve 120 near the black cap end of the sleeve. As the tumbler body 100 is driven upwardly as indicated by arrow 166 (FIGS. 8 and 9) the trip finger 165 encounters and depresses plunger 162, as indicated by the dashed-line position of finger 165 in FIG. 9.

Referring to FIGS. 4, 10 and 11, to secure the printhead 34, 35 in a fixed position relative to the tumbler axis 70, the service station 50 has a printhead locking mechanism 168 that engages the carriage 38. The locking mechanism 168 has sled member 169 and a carriage lock finger 170 extending upwardly from the sled. The sled 169 is driven by the drive mechanism 84 rearwardly, in the direction indicated by arrow 172, to engage the carriage 38 (FIG. 11). To draw the lock finger 170 out of engagement with carriage 38, the locking mechanism 168 includes a post 174, which is coupled by a spring 175 to either the service station frame 82, or to a support post 176 which advantageously extends from an outer housing portion 178 (FIG. 4) of the drive mechanism 84.

In the illustrated embodiment of FIG. 4, the drive mechanism outer housing 178 defines a pair of slots 180, which translationally receive a pair of posts 182 which extend outwardly from the right side (as viewed in FIG. 4) of sled 169. Similarly, the service station frame 82 includes a slot for receiving another mounting post (not shown) extending outwardly from the left side (FIG. 4 view) of sled 169. Also extending outwardly from the left side of sled 169 is a sliding arm 186 which slides along a sliding surface 188 defined by the service station frame 82.

FIGS. 10 and 11 show how the illustrated drive mechanism 84 moves the caps 54, 55 and wipers 110, 112 into their servicing positions, as well as how the carriage locking mechanism 168 engages carriage 38 to secure the printhead 34, 35 into position for capping. The motor-driven pinion gear 86 engages an input gear 190 of a reduction gear set 192. An output gear 194 of gear set 192 engages an input gear 196 of a cammed gear set 198. The gear sets 192 and 198 are suspended on shafts which extend from the service station frame 82 to the outer housing 178 (FIG. 4) of the drive mechanism 84. To provide clearance for the shaft of the cammed gear set 198, which protrudes slightly through the service station frame 82, the surface of the out-board wall of sleeve 120 has a series of arcuate grooves 199 formed therein, as shown in FIG. 5.

The cammed gear set 198 has a cam track 200 (shown in dashed lines) along the interior side facing the service station frame 82. A partially-toothed output gear 202 extends from the interior side of the gear set 198 to selectively engage an input gear 204 on the tumbler input shaft 102. The extreme end of the input shaft 102 serves as a cam-follower 205 which rides within the cam track 200 as the cammed gear set 198 rotates. The cam track 200 has a tumbler rotating segment 206 and a tumbler elevating segment 208. When the cam follower 205 is located in the rotating segment 206 of track 200, which is substantially concentric with the input gear 196, the partially-toothed output gear 202 engages the tumbler input gear 204 to rotate the tumbler 100 between capping and wiping positions. FIG. 10 shows the drive mechanism 84 and the tumbler 100 oriented in a wiping position, where either the black wiper 110 may be positioned to wipe the black printhead 34, or the color wiper 112 may be positioned to wipe the color printhead 35.

When rotation of the tumbler 100 (by engagement of gears 202 and 204) has positioned the cap 54, 55 under the printhead, then further rotation of the cammed gear set 198 moves the cam follower 205 into the elevation segment 208 of the cam track 200. As the cam follower 205 transitions from the rotating segment 206 to the elevating segment 208, the gears 202 and 204 are disengaged, and rotation of the tumbler 100 stops. FIG. 11 shows the drive mechanism 84 and the tumbler 100 oriented in a capping position, where either the black cap 54 may be positioned to seal the black printhead 34, or the color cap 55 may be positioned to seal the color printhead 35. To assist in translational travel of the sleeve 120 toward the printheads 34, 35, the inner surface of the service station wall adjacent the drive mechanism 84 may have a pair of guide rails (not shown) formed thereon between which the sleeve slides.

This basic cap selection and elevation system (gears 86, 192, 198, 204; cam track 200 and shaft cam follower 205) was first used in the DeskJet 310 and DeskJet 320 models of portable inkjet printers, produced by the Hewlett-Packard Company of Palo Alto, Calif., but was oriented toward the front of the printer (perpendicular to the position illustrated in the drawing figures). However, the carriage locking mechanism 168 is an improvement disclosed for the first time herein.

Orienting the drive mechanism 84 as shown in FIGS. 4, 10 and 11, allows the carriage locking mechanism 168 to engage the carriage 38 in a direction substantially perpendicular to the path of carriage travel defined by the scanning axis 105 (FIG. 4). To move the lock finger 170 into engagement with the carriage 38, the drive mechanism 84 includes an L-shaped actuating arm 210, which is pivotally attached to the service station frame 82 at pivot post 212. The arm 210 has a crescent-shaped cam follower 214 which engages a lifting cam or disk 216 located on the tumbler shaft 102, between the service station frame 82 and the tumbler input gear 204. The arm 210 also has a lifting ramp portion 218 that moves upwardly into a slot 220 formed through the interior of the locking mechanism sled 169. In the illustrated embodiment, the sled post 182 extends from the right side (FIG. 4) of the sled, through slot 220, and projects outwardly from the left side of the sled (not shown).

FIG. 10 shows the locking finger 170 disengaged from the carriage 38, with the actuating arm 210 resting against a stop 222, which projects outwardly from the service station frame 82. The stop 222 prevents further downward rotation of the actuating arm 210 to avoid interference with other components of the drive mechanism 84. As the cammed gear set 198 rotates, the tumbler shaft follower 205 moves along the cam track 200 from the rotating segment 206 of FIG. 10, to the elevating segment 208 shown in FIG. 11. As the tumbler 100 rises, the lift disk 216 moves upwardly until the majority of the crescent follower 214 rests on the periphery of disk 216. This transition pivots the arm 210 around post 212, forcing the ramp 218 to ride along the portion of post 182 that extends through slot 220, which draws the locking finger 170 into engagement with the carriage 38 as sled 169 moves in the direction of arrow 172. Further rotation of gear set 198 (from the position of FIG. 11 to that of FIG. 10), lowers the arm 210, allowing the force of tension spring 175 to pull the sled 169 toward the front of the printer 20 (opposite arrow 172), unlocking the carriage 38.

In operation, after being shut down or after a period of inactivity, the printer 20 is initially started, such as by pressing one of the switches on keypad 42. Initially, the stepper motor 88 moves approximately 50 steps, for example, to disengage either cap 54 or 55 from which ever cartridge 30, 32 is installed in the printer 20. After lowering the caps 54 or 55, the carriage 38 exits from the servicing region over the service station 50 and moves toward the print media 25 (toward the left in FIGS. 1 and 4). Before beginning a servicing routine, the controller 40 determines which pen is installed in carriage 38. Then the controller 40 must determine the rotational position of the tumbler 100.

The service station 50 has advantageously replaced expensive optical position feedback systems with a microswitch activating device which allows the service station 50 to communicate to the printer controller 40 a rotary reference position of the tumbler 100. In the illustrated embodiment, the service station motor 88 rotates until the black cap 54 is in a fully upright capping position, as indicated by arrow 166 in FIG. 9. Here, in dashed lines the trigger finger 165 is shown depressing microswitch plunger 162, which activates microswitch 160 to send a home position signal 164 to the controller 40. Upon closing the microswitch 160, the controller then establishes a new home position for motor 88, and then continues to control motor 88 via a motor control signal 224.

Upon establishing the new home position, the motor 88 is then driven the proper number of counts to rotate the tumbler 100 to service whichever pen 30 or 32 is installed in the carriage 38. The manner of identifying which pen 30, 32 is installed in carriage 38, may be accomplished in a variety of ways known to those skilled in the art, including reading an electronic identification code stored within the pens 30, 32, or by having the pen bodies configured differently to active or not activate a mechanical registering device on the carriage 38, which then generates an electrical signal that is supplied to controller 40.

For example, to wipe the black printhead 34, the tumbler body 100 is rotated so the black wiper 110 is in an upright position, then the carriage 38 reciprocates back and forth over the wiper 110. Similarly, to wipe the color printhead 35, the color wiper 112 is rotated into an upright position. The carriage 38 may then move the printhead over the spittoon catch basin 92, to purge the printhead by spitting, which is useful to clear any clogged nozzles. Of course, it may be more advantageous to spit first in spittoon 90, then to wipe the printhead with the appropriate wiper 110 or 112.

During periods of printer inactivity, it is preferable to seal the printheads 34, 35 with the appropriate cap 54, 55 to prevent the ink from drying out. To cap the nozzles of printheads 34, 35, the carriage 38 moves the installed printhead over the capping assembly to align the nozzles inside lips 134, 144, depending upon which pen is installed. The motor 88 then drives the drive mechanism 84, first to rotate the appropriate cap 54, 55 into the upright position, then to raise the tumbler 100 and sleeve 120 upwardly, as indicated by arrow 106 in FIG. 4. The sleeve 52 moves a fixed distance upward, and then any variation in the pen height with respect to the service station frame 82 is accommodated by compression of spring 60. The caps 54, 55 are able to compensate for any lack of parallelism between the plane of the printhead face, and the cap lips 134, 144 by sizing the guides and posts aligning sleeve 120 with the bases 56, 58 to allow for tilting of the caps with respect to the sleeve 120. To disengage the caps 54, 55 from the respective printheads 34, 35 the motor 88 drives the gear cam assembly to lower sleeve 120, which allows the carriage 38 to move the pens 30, 32 away from the service station 50.

Advantages

Thus, the service station 50, with the illustrated capping assembly 51 automatically accommodates for varying pen-to-paper spacing, that is, varying heights of the printheads 34, 35 relative to the service station frame 82 and the chassis 22. The service station frame 82 may be mounted in a fixed location of the chassis 22, without requiring separate vertical adjustment of the service station frame 82, which was needed in earlier printers. This lack of a separate vertical adjustment advantageously speeds manufacturing and allows the production of a more economical printing mechanism 20. Earlier designs which had spring loaded caps, required two separate springs, each pushing a single one of the caps upwards. Since the black and color caps 54, 55 each use a common single spring 60, this decreases the number of parts required to assemble the service station 50, and thus printer 20. Thus, the capping assembly 51, 80, advantageously provides for a more economical printer 20.

The performance of the capping assembly 51 is also enhanced over earlier designs. Capping force, that is the force with which the cap lips 134, 144 press against the printheads 34, 35 was varied in the past by adjusting the hardness, or durometer of the elastic material from which the caps 54, 55 are made. Instead, using the capping assembly 51 described herein, the capping force may be varied by selecting the spring 60 to have a desired spring force for a desired range of deflection. Preferably, the capping force varies little with deflection on a particular spring chosen, to maintain a substantially constant capping force, which is minimally impacted by the amount of deflection of the spring 60 (see distance X in FIG. 3). Thus, the capping assembly 51 is able to seal the printheads 34, 35 reasonably well, and to accommodate for a large variation of pen-to-paper spacing by controlling the spring force, and the amount of vertical translation the cap needs to move when performing the capping function (distance X in FIG. 3).

As a further advantage, as the caps 54, 55 float and gimbal when resting on spring 60, they also pivot or gimbal at the center axis of the caps 54, 55. This pivoting allows the caps to take into account any variation in angle (lack of parallelism) between the cap sealing lips 134, 144 and the face of printheads 34, 35. These variations in pen-to-paper spacing may be result from tolerance stacking, where the various tolerances of the individual parts are at a particular extreme. Additionally, use of the spring loading for caps 54, 55 to seal, rather than requiring compression of the caps 54, 55, prevents permanent deformation of the caps, such as after periods of long storage, which avoids the problem in the earlier printers of a poor seal being experienced on pens installed later.

Several other advantages are also realized by implementing the concepts illustrated by service station 50. For example, shorter service times may be possible by locating the spittoon 90 between the wipers 110, 112 and caps 54, 55. For example, in earlier printing mechanisms, the spittoon was most often positioned adjacent the printzone. Here, after a nozzle-clearing spitting sequence, the printhead face can be wiped in a single pass if desired, as the printhead travels back toward the printzone (to the left in FIGS. 1 and 4).

Earlier printing mechanisms were unable to compensate for variations in the pen-to-paper spacing when securing the printhead carriage in place for capping. Here, the printhead locking mechanism 168 securely engages the carriage 38, regardless of any variation in the vertical elevation of the printhead, i.e. pen-to-paper spacing, which may vary from cartridge to cartridge. As best shown in FIG. 4, the locking finger 170 has a V-shaped groove that extends along the engagement length of finger 170 to engage a mating projecting ridge or other projecting portion of the carriage 38. This ability to compensate for variations in the pen-to-paper elevation of the printheads 64, 66 when locking the carriage in a capping position is a significant advantage over the earlier carriage locking systems.

We claim:

1. A service station for servicing the printheads of a first inkjet cartridge and a second inkjet cartridge which are interchangeably installed in a single-cartridge inkjet printing mechanism, comprising:

a frame;

a restraining sleeve pivotally and translationally coupled to the frame, the sleeve defining a hollow interior that terminates in a first end and an opposing second end;

a first cap restrained within the hollow interior of the sleeve and sized to seal the first inkjet cartridge;

a second cap restrained within the hollow interior of the sleeve and sized to seal the second inkjet cartridge; and a biasing member received within the hollow interior of the sleeve to bias the first cap toward the first end of the sleeve and to bias the second cap toward the second end of the sleeve.

2. A service station according to claim 1 further including a drive mechanism coupled to the sleeve to rotate and translate the sleeve to selectively position either the first cap or the second cap into a printhead sealing position.

3. A service station according to claim 2 further including a printhead locking element coupled to the drive mechanism to selectively secure whichever of the first inkjet cartridge or the second inkjet cartridge is installed by a user in a single-cartridge carriage of the inkjet printing mechanism in a printhead sealing position by engaging the carriage, which reciprocates along a scanning axis, in a direction perpendicular to said scanning axis.

4. A service station according to claim 1 further including a tumbler that supports the sleeve for pivotal and translational movement of the sleeve relative to the frame.

5. A service station according to claim 4 further including:

a first wiper supported by the tumbler being rotated into a printhead wiping position to wipe the printhead of the first cartridge when installed by a user in the single-cartridge inkjet printing mechanism; and a second wiper supported by the tumbler being rotated into a printhead wiping position to wipe the printhead of the second cartridge when installed by a user in the single-cartridge inkjet printing mechanism.

6. A service station according to claim 5 wherein the tumbler has a periphery across which a first diameter traverses and across which a second diameter traverses, with the first cap and the second cap being aligned along the first diameter of the periphery, and the first wiper and the second wiper being aligned along the second diameter of the periphery, with the first diameter and the second diameter being mutually perpendicular.

7. A service station according to claim 5 wherein:

the tumbler has a wiper support portion that supports the first wiper and the second wiper, and a cap support portion that supports the sleeve; and further including a spittoon having a catch basin extending over the tumbler between the wiper support portion and the cap support portion.

8. A service station according to claim 1 further including:

a first base unit coupled to the sleeve adjacent the first end of the sleeve to slidably support the first cap in the sleeve; and a second base unit coupled to the sleeve adjacent the second end of the sleeve to slidably support the second cap in the sleeve.

9. A service station according to claim 8 wherein:

the sleeve has a first set of slots adjacent the first end and a second set of slots adjacent the second end;

the first base unit engages the first set of slots in the sleeve for sliding and pivotal motion of the first base unit with respect to the sleeve; and the second base unit engages the second set of slots in the sleeve for sliding and pivotal motion of the second base unit with respect to the sleeve.

10. A service station according to claim 8 wherein:

the first base unit and the second base unit each have a tubular structure with a first end and a second end, with the first end having a cap mount and the second end having a mounting portion coupled to the sleeve, with the mounting portion of each of the first base unit and the second base unit defining a hollow interior;

the first cap has a tubular structure with a first end thereof having a printhead sealing lip and a second end thereof having an opposing mounting portion coupled to the cap mount of the first base unit;

the second cap has a tubular structure with a first end thereof having a printhead sealing lip and a second end thereof having an opposing mounting portion coupled to the cap mount of the second base unit;

further including a first cap cover received by the mounting portion of the first base unit to seal the second end of the first base unit tubular structure; and further including a second cap cover received by the mounting portion of the second base unit to seal the second end of the second base unit tubular structure.

11. A service station according to claim 10 wherein:

the first cap cover is recessed within the hollow interior of the mounting portion of the first base unit to define a first pocket;

the second cap cover is recessed within the hollow interior of the mounting portion of the second base unit to define a second pocket; and the biasing member comprises a coil spring having a first end and a second end with the first end of the coil spring being received within the first pocket, and the second end of the coil spring being received within the second pocket.

12. A method of servicing an inkjet printhead of either a first inkjet cartridge or a second inkjet cartridge when interchangeably installed in a single-cartridge inkjet printing mechanism, comprising the steps of:

identifying whether the first inkjet cartridge or the second inkjet cartridge is installed;

rotating a cap retaining sleeve holding a first printhead cap and a second printhead cap to place the first cap in a printhead sealing position when the first inkjet cartridge is identified, and to place the second cap in the printhead sealing position when the second inkjet cartridge is identified; and biasing the first cap and the second cap toward opposite ends of the retaining sleeve using a single biasing member.

13. A method according to claim 12 further including the steps of:

after the rotating step, translationally moving the sleeve toward the printhead; and sealing the printhead of said installed cartridge by compressing the single biasing member.

14. A method according to claim 13 further including the step of, during the translationally moving step, locking the printhead, said installed cartridge at a sealing location by engaging a carriage, which reciprocates the installed cartridge along a scanning axis, in a direction perpendicular to said scanning axis.

15. A method according to claim 12 further including the steps of:

supporting the cap retaining sleeve on a tumbler, and supporting a first wiper and a second wiper on the tumbler; and rotating the tumbler to place the first wiper in a printhead wiping position when the first inkjet cartridge is identified, and to place the second wiper in the printhead wiping position when the second inkjet cartridge is identified.

16. A single-cartridge inkjet printing mechanism for receiving either a first inkjet cartridge or a second inkjet cartridge, with the first inkjet cartridge and the second inkjet cartridge each having a printhead with mutually different servicing requirements, the printing mechanism comprising:

a chassis;

a carriage supported by the chassis for reciprocal movement during printing, with the carriage interchangeably receiving either the first inkjet cartridge or the second inkjet cartridge;

a controller coupled to the carriage to determine whether the first inkjet cartridge or the second inkjet cartridge is installed in the carriage; and a service station coupled to the controller to service the printhead of either the first inkjet cartridge or the second inkjet cartridge when installed in the carriage in response to the controller, with the service station including:

a restraining sleeve pivotally and translationally coupled to the chassis, the sleeve defining a hollow interior that terminates in a first end and a second end;

a first cap restrained within the hollow interior of the restraining sleeve and sized to seal the first inkjet cartridge;

a second cap restrained within the hollow interior of the restraining sleeve and sized to seal the second inkjet cartridge; and a biasing member received within the hollow interior of the restraining sleeve to bias the first cap toward the first end of the restraining sleeve and the second cap toward the second end of the restraining sleeve.

17. A single-cartridge inkjet printing mechanism according to claim 16, wherein the service station further includes a drive mechanism coupled to the sleeve to rotate and translate the sleeve to selectively position either the first cap or the second cap into a printhead sealing position.

18. A single-cartridge inkjet printing mechanism according to claim 17, wherein the service station further includes a locking element coupled to the drive mechanism to selectively secure the installed cartridge in a printhead sealing position by engaging a carriage, which reciprocates the installed cartridge along a scanning axis, in a direction perpendicular to said scanning axis.

19. A single-cartridge inkjet printing mechanism according to claim 17, wherein the service station further includes:

a tumbler pivotally and translationally coupling the sleeve to the chassis;

a first wiper supported by the tumbler and being rotated into a printhead wiping position to wipe the printhead of the first cartridge when said first cartridge is installed in said carriage; and a second wiper supported by the tumbler and being rotated into a printhead wiping position to wipe the printhead of the second cartridge when said second cartridge is installed in said carriage.

* * * * *

UNITED STATES PATENT AND TRADEMARK OFFICE

CERTIFICATE OF CORRECTION

PATENT NO. : 5,757,395
DATED : May 26, 1998
INVENTOR(S) : Chew et al.

It is certified that error appears in the above-identified patent and that said Letters Patent is hereby corrected as shown below:

On the title page, item [54] and column 1, lines 1-2:

Delete "COLOR CAPABLE SINGLE-CARTRIDGE INKJET SERVICE STATION" and insert therefor -- INTERCHANGEABLE SINGLE-CARTRIDGE INKJET SERVICE STATION --.

Column 3 (line 36), delete "FIGS. 2" and insert therefor -- FIG. 2 --.

Column 6 (line 3), before "FIGS.", insert -- ( --.

In the Claims

Column 14 (line 36), delete the second "a" and insert therefor -- an opposing --.

Column 14 (line 37), delete "an opposing" and insert therefor -- a --.

Column 14 (line 40), delete the second "a" and insert therefor -- an opposing --.

Column 14 (line 41), delete "an opposing" and insert therefor -- a --.

Column 14 (line 58), after second "end" insert -- , --.

UNITED STATES PATENT AND TRADEMARK OFFICE

CERTIFICATE OF CORRECTION

PATENT NO. : 5,757,395

DATED : May 26, 1998

INVENTOR(S) : Chew et al.

It is certified that error appears in the above-identified patent and that said Letters Patent is hereby corrected as shown below:

Column 15 (line 13), after "printhead" insert -- of said installed cartridge --.

Column 15 (line 18), after "printhead" delete "," and insert therefor -- of --.

Signed and Sealed this

Nineteenth Day of January, 1999

*Attest:*

*Attesting Officer*

*Acting Commissioner of Patents and Trademarks*